US009205946B2

(12) United States Patent
Toribio et al.

(10) Patent No.: US 9,205,946 B2
(45) Date of Patent: Dec. 8, 2015

(54) REINFORCED NECK FINISH FOR CONTAINER

(71) Applicant: Silgan Plastics LLC, Chesterfield, MO (US)

(72) Inventors: Anthony Toribio, Suwanee, GA (US); Randal D. Porter, Norcross, GA (US); William J. Peek, Lawrenceville, GA (US)

(73) Assignee: SILGAN PLASTICS LLC, Chesterfield, MO (US)

( * ) Notice: Subject to any disclaimer, the term of this patent is extended or adjusted under 35 U.S.C. 154(b) by 363 days.

(21) Appl. No.: 13/762,696

(22) Filed: Feb. 8, 2013

(65) Prior Publication Data

US 2013/0206718 A1 Aug. 15, 2013

Related U.S. Application Data

(60) Provisional application No. 61/597,552, filed on Feb. 10, 2012.

(51) Int. Cl.
*B65D 1/02* (2006.01)
*B65D 1/46* (2006.01)

(52) U.S. Cl.
CPC ..... *B65D 1/46* (2013.01); *B65D 1/0246* (2013.01)

(58) Field of Classification Search
CPC ..... B65D 1/023; B29C 49/06; B29B 2911/14033; B29B 2911/1404; B29B 2911/14333
USPC ..... 215/40, 42, 204, 217, 219, 220, 222, 215/223, 228, 230, 252, 253, 256, 306, 330, 215/331, 350, 381, 44; 220/268, 293; 222/109, 111, 129, 48, 482, 549
See application file for complete search history.

(56) References Cited

U.S. PATENT DOCUMENTS

| | | | | |
|---|---|---|---|---|
| 2,423,582 | A * | 7/1947 | Coleman | 215/252 |
| 2,790,576 | A | 4/1957 | Lawrence | |
| 3,295,708 | A | 1/1967 | Wathen, Jr. | |
| 3,402,842 | A * | 9/1968 | Millian | 215/217 |
| 4,434,903 | A * | 3/1984 | Cooke | 215/222 |
| 4,875,594 | A * | 10/1989 | Ochs | 215/252 |
| 4,934,547 | A * | 6/1990 | Mayes et al. | 215/306 |
| 4,936,475 | A * | 6/1990 | Montgomery | 215/252 |
| 5,992,659 | A * | 11/1999 | Nofer et al. | 215/235 |
| D460,357 | S | 7/2002 | Kras et al. | |
| 6,648,157 | B2 | 11/2003 | Shai et al. | |

(Continued)

OTHER PUBLICATIONS

U.S. Appl. No. 29/413,097, filed Feb. 10, 2012, Toribio et al.

*Primary Examiner* — Fenn Mathew
*Assistant Examiner* — Cynthia Collado
(74) *Attorney, Agent, or Firm* — Reinhart Boerner Van Deuren s.c.

(57) ABSTRACT

A plastic container including a body and a neck portion extending from the body is provided. The container includes a first anti-rotation lug extending radially outward from the outer surface of the upper section of the neck portion. The container includes a second anti-rotation lug extending radially outward from the outer surface of the upper section of the neck portion and spaced apart from the first anti-rotation lug. The container includes a first buttress extending radially outward from the outer surface of the upper section of the neck portion and positioned between the first and second anti-rotation lugs. The first buttress reinforces the neck portion between the first and second anti-rotation lugs.

20 Claims, 8 Drawing Sheets

(56) References Cited

U.S. PATENT DOCUMENTS

| | | | | |
|---|---|---|---|---|
| 6,766,916 | B2 * | 7/2004 | Ma | 215/252 |
| D542,654 | S | 5/2007 | Szczesniak | |
| D542,655 | S | 5/2007 | Szczesniak | |
| D542,656 | S | 5/2007 | Szczesniak | |
| D544,348 | S | 6/2007 | Szczesniak | |
| D633,386 | S | 3/2011 | Taber et al. | |
| D634,199 | S | 3/2011 | Taber et al. | |
| 7,976,767 | B2 | 7/2011 | Ungrady et al. | |
| 8,231,020 | B2 | 7/2012 | Taber et al. | |
| 8,727,167 | B2 * | 5/2014 | Soh | 220/258.1 |
| 2006/0283896 | A1 * | 12/2006 | Kasting | 222/549 |
| 2011/0290755 | A1 | 12/2011 | Taber et al. | |

* cited by examiner

REINFORCED NECK FINISH FOR CONTAINER

CROSS-REFERENCE TO RELATED PATENT APPLICATION

This application claims the benefit of U.S. Provisional Patent Application No. 61/597,552 titled "REINFORCED NECK FINISH FOR CONTAINER," filed Feb. 10, 2012, which is incorporated herein by reference in its entirety.

BACKGROUND OF THE INVENTION

The present invention relates generally to the field of containers. The present invention relates specifically to a container having a reinforced or strengthened neck finish.

Containers, such as plastic bottles, are used to hold a wide variety of materials, including foods, beverages, various household and industrial chemicals, including cleaning fluids, bleach, fuel, lighter fluid, etc. Plastic bottles typically have a neck finish having a structure (e.g., threads) for attaching a closure or cap to the bottle. The closure acts to seal an opening at the upper end of the neck finish and may provide for dispensing of the material from the bottle.

SUMMARY OF THE INVENTION

One embodiment of the invention relates to a plastic container including a body and a neck portion extending from the body. The neck portion includes an upper section having an outer surface and a lower section having an outer surface. The lower section is positioned between the body and the upper section. The container includes threads extending radially outward from the outer surface of the lower section of the neck portion, and the threads are configured to engage a closure. The container includes a first anti-rotation lug extending radially outward from the outer surface of the upper section of the neck portion, and the first anti-rotation lug includes a clockwise facing engagement surface. The container includes a second anti-rotation lug extending radially outward from the outer surface of the upper section of the neck portion and spaced apart from the first anti-rotation lug, and the second anti-rotation lug includes a clockwise facing engagement surface. The container includes a first buttress extending radially outward from the outer surface of the upper section of the neck portion and positioned between the first and second anti-rotation lugs. The first buttress reinforces the neck portion between the first and second anti-rotation lugs.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Referring generally to the figures, a container having a reinforced (e.g., strengthened, buttressed, supported, etc.) neck portion or finish is shown according to various exemplary embodiments. The neck finish includes one or more buttresses that are shaped to support or reinforce the material of the neck finish. For example, the reinforcement provided by the strengthening features discussed herein acts to limit or prevent breakage of the neck finish that may occur on impact. In such embodiments, the buttresses may act to absorb energy imparted to the neck finish upon impact. In other embodiments, the buttresses may act to limit deformation during processing or molding, and may act to limit deformation during closure attachment. In some embodiments, the neck finish includes anti-rotational lugs configured to engage structures of the closure (e.g., closure ratchet teeth) when the closure is fully engaged to the neck finish. In these embodiments, the buttresses that strengthen the neck finish are configured to allow the engagement structures of the closure to traverse or pass over the buttresses in way that does not significantly inhibit attachment of the closure to the neck finish.

As discussed in more detail below, depending on the structure of various containers and container necks, various combinations of the particular structural arrangements, sizes, shapes, relational positions, etc., of the buttresses and of the neck finish structures may provide a reinforced or strengthened neck finish. Further, various combinations of the particular structural arrangements, sizes, shapes, relational positions, etc., of the buttresses and of the neck finish structures may allow for convenient application of a closure, and particularly a closure including internal anti-rotation ratchet teeth. In addition, various combinations of the particular structural arrangements, sizes, shapes, relational positions, etc., of the buttresses and of the neck finish structure may allow for simple disengagement from molding equipment. In the various embodiments discussed herein, the buttresses may be spaced, shaped, placed and/or sized based upon the associated container.

Figure 1:
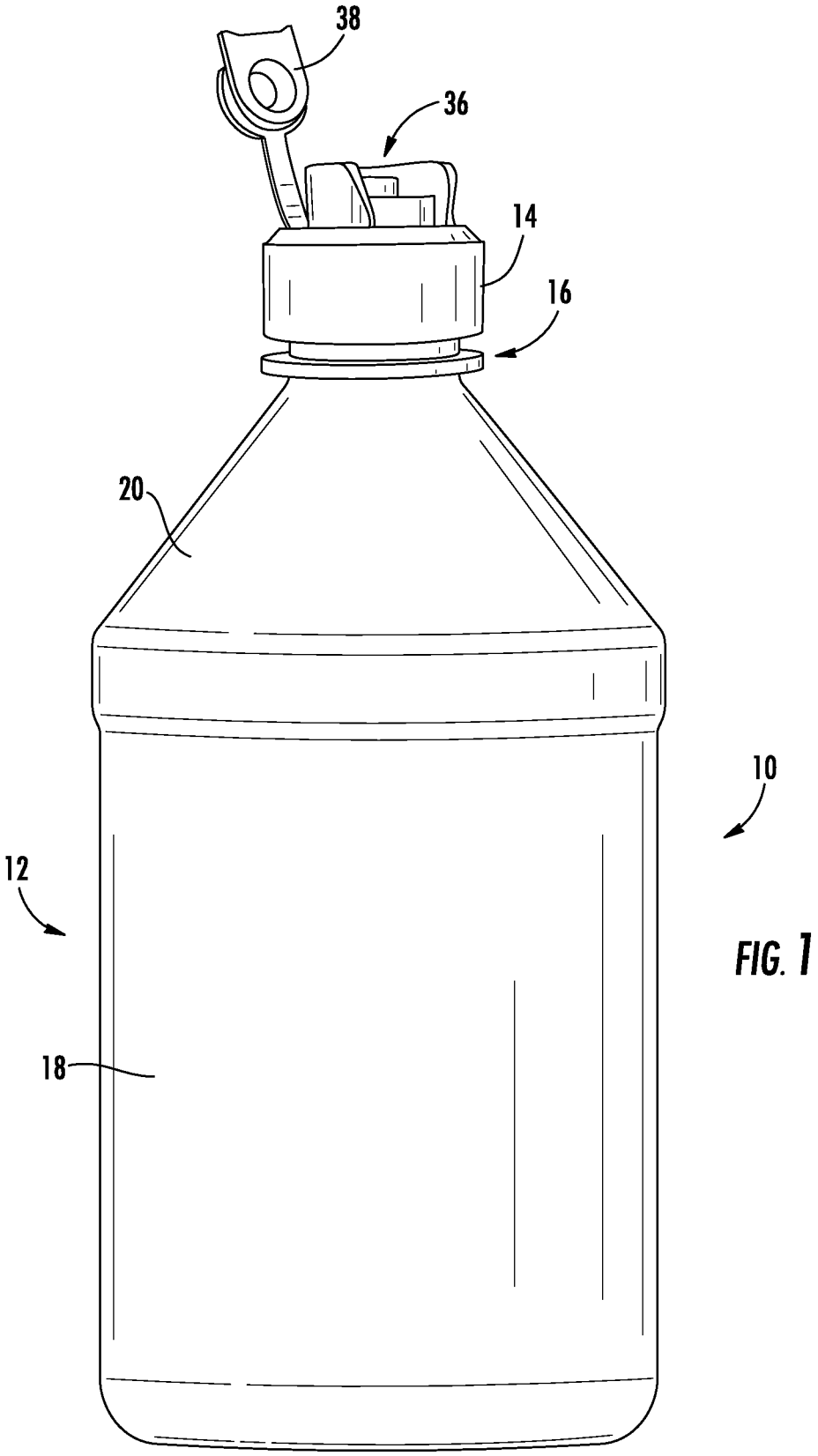
FIG. 1 is a perspective view of a container and closure according to an exemplary embodiment.

Referring to FIG. 1, a container, shown as bottle 10, is depicted according to an exemplary embodiment. Bottle 10 includes a body 12 and a closure 14 coupled to a neck portion of bottle 10, shown as neck finish 16, in FIG. 2. Body 12 includes a lower portion 18 and an upper portion 20. In the embodiment shown, upper portion 20 is an angled portion transitioning between the wider lower portion 18 to narrower neck finish 16. Body 12 includes an internal surface that defines an interior cavity in which the contents of bottle 10 may be stored.

Figure 2:
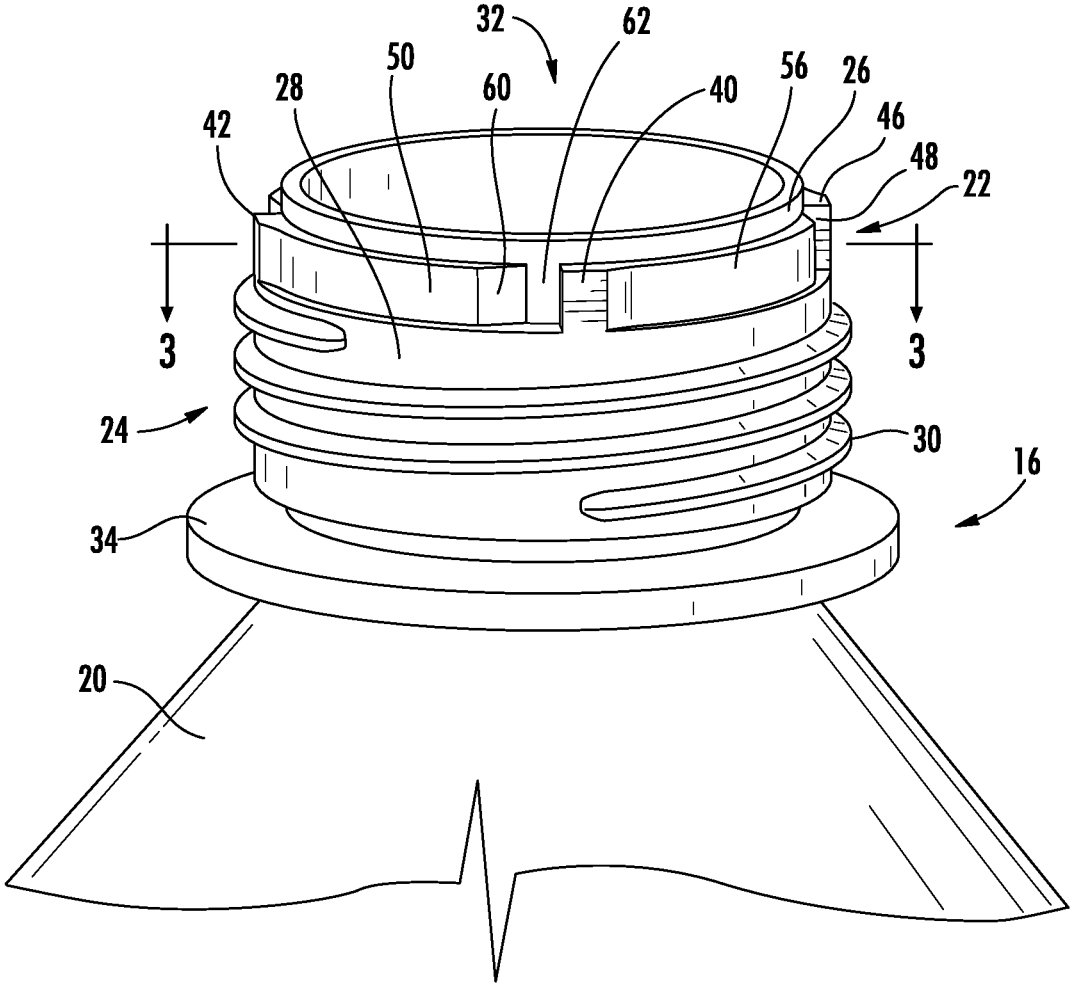
FIG. 2 is a detailed view of the neck finish of a container according to an exemplary embodiment.

Referring to FIG. 2, a detailed view of upper portion 20 of body 12 and of neck finish 16 are shown following removal of closure 14. Neck finish 16 extends from the upper end of body 12. Neck finish 16 includes an upper portion 22 and a lower portion 24. As shown in FIG. 2, lower portion 24 is located between body 12 and upper portion 22, and extends from the upper end of upper body portion 20. In the embodiment of FIG. 2, upper portion 22 is a generally cylindrical portion defining a generally cylindrical outer surface 26, and lower portion 24 is a generally cylindrical portion defining a generally cylindrical outer surface 28.

Threads 30 extend radially outward of outer surface 28. Threads 30 are configured to engage cooperative threading located along the inner surface of closure 14. The upper edge of upper neck portion 22 defines a opening 32 through which the contents of bottle 10 may be removed. As shown in FIG. 1, closure 14 is threaded onto neck finish 16 and includes a dispensing opening 36 and a flip-top cap 38. As explained below, closure 14 is configured to prevent or resist unthreading from neck finish 16 once closure 14 has been fully threaded on to the neck finish. Thus, following attachment of closure 14, the contents of bottle 10 are dispensed by opening flip-top cap 38, and thereby, permitting contents to be dispensed through both neck opening 32 and dispensing opening 36 of closure 14.

A collar 34 extends radially outward from outer surface 28 from a position below threads 30. In various embodiments, collar 34 acts to support bottle 10 (and the preform from which bottle 10 is formed) during various stages of the molding process, for example, during handling via a transfer mechanism, supporting a preform/bottle within the mold, etc.

Figure 3:
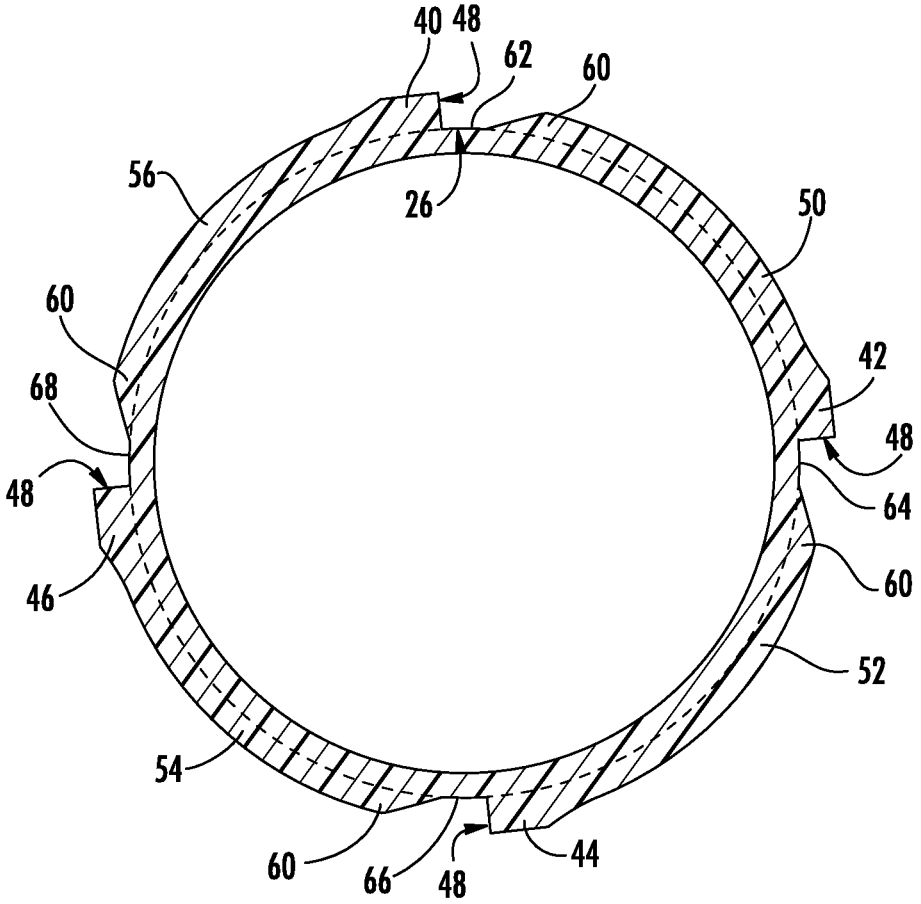
FIG. 3 is a top, cross-sectional view of the neck finish of FIG. 2 according to an exemplary embodiment.

Referring to FIG. 2 and FIG. 3, bottle 10 includes one or more anti-rotation lugs, shown as first anti-rotation lug 40, second anti-rotation lug 42, third anti-rotation lug 44, and fourth anti-rotation lug 46. Lugs 40, 42, 44 and 46 extend radially outward from outer surface 26 such that the radii at points along the outer surfaces of lugs 40, 42, 44 and 46 are greater than the radius of outer surface 26. Referring to FIG. 2, lugs 40, 42, 44 and 46 have a height dimension that extends along outer surface 26 longitudinally parallel to the longitudinal axis of container 10. In the embodiment shown, lugs 40, 42, 44 and 46 have a height less than the height of upper portion 22 such that a portion of outer surface 26 is positioned above each anti-rotation lug.

Referring to FIG. 3, lugs 40, 42, 44 and 46 each have a clockwise facing engagement surface 48. Engagement surfaces 48 are substantially perpendicular to the outer surface 26 and extend radially outward from outer surface 26 to the radial outer surface of the lugs. Engagement surfaces 48 are positioned to engage teeth (e.g., ratchet teeth) located along the inner surface of closure 14 to resist or prevent counterclockwise rotation of closure 14 relative to neck finish 16. The teeth of closure 14 are sized and positioned to engage with engagement surfaces 48 after closure 14 has been fully threaded on to neck finish 16 resisting or preventing the unthreading and removal of closure 14 once the closure has been fully attached.

In the embodiment shown, the engagement surfaces 48 of adjacent lugs 40, 42, 44 and 46 are spaced from each other by 90 degrees around the circumference of neck finish 16. In another embodiment, the angular spacing between the engagement surfaces 48 of adjacent lugs 40, 42, 44 and 46 is between 89 and 90 degrees. In another embodiment, the angular spacing between the engagement surfaces 48 of adjacent lugs 40, 42, 44 and 46 is 90 degrees plus or minus one degree, and more specifically is 90 degrees plus or minus a half of a degree.

As noted above, bottle 10 includes one or more buttresses or support structures that act to strengthen the wall of neck finish 16. In the embodiment of FIGS. 2 and 3, bottle 10 includes one or more buttresses, shown as first buttress 50, second buttress 52, third buttress 54 and fourth buttress 56. Buttresses 50, 52, 54 and 56 extend radially outwardly from outer surface 26 of upper portion 22 of neck finish 16. As best shown in FIG. 3, first buttress 50 is positioned between first lug 40 and second lug 42, second buttress 52 is positioned between second lug 42 and third lug 44, third buttress 54 is positioned between third lug 44 and fourth lug 46, and fourth buttress 56 is positioned between fourth lug 46 and first lug 40. It should be understood that in this context positioned between indicates relative positioning between elements along the outer surface of the neck finish, and in the context of cylindrical neck finish indicates relative positioning between elements along the circumference of the neck finish.

In the embodiment shown in FIG. 3, each buttress 50, 52, 54 and 56 is a radially projecting arc of material that is contiguous or integral with the material of lugs 42, 44, 46, and 40, respectively. Further, each buttress 50, 52, 54 and 56 may also be made of material that is continuous or integral with the material of neck finish 16. In the specific embodiment shown, the outermost surface of each buttress is continuous arc having a constant radius over at least more than half of the length of the buttress. Each buttress 50, 52, 54 and 56 extends along enough of the circumferential distance between consecutive lugs to reinforce the sidewall between consecutive lugs. In various embodiments, buttresses 50, 52, 54 and 56 extend more than 30 percent of the circumferential distance between consecutive lugs, specifically extend more than 50 percent of the circumferential distance between consecutive lugs, and more specifically extend more than 75 percent of the circumferential distance between consecutive lugs.

Each buttress 50, 52, 54 and 56 includes a counterclockwise facing, tapered end 60. Tapered end 60 tapers radially inward to provide the transition from the increased radius of the buttress to the smaller radius of outer surface 26 of upper section 22 of neck finish 16. Further, tapered end 60 provides a gradual sloped surface that allows the ratchet teeth of the closure to cam over the buttresses during threading of closure 14.

Because tapered end 60 of each buttress 50, 52, 54 and 56 terminates prior to reaching the adjacent lug on the counterclockwise side of the buttress, an exposed portion of the sidewall creates a gap immediately counterclockwise from each tapered end 60. For example, as shown in FIG. 3, positioned counterclockwise from each buttress, outer surface 26 includes a plurality of sidewall sections, shown as first sidewall section 62, second sidewall section 64, third sidewall section 66 and fourth sidewall section 68. Each sidewall section 62, 64, 66 and 68 is located adjacent to the engagement surface of the lug positioned counterclockwise from the buttress. In the embodiment shown in FIG. 3, because upper portion 22 of neck finish 16 is substantially cylindrical, the radius of neck finish 10 is the same at all sidewall sections 62, 64, 66 and 68. Sidewall sections 62, 64, 66 and 68 provide a gap or spacing between the clockwise facing engagement surface 48 and the buttress located clockwise from the engagement surface. The space provided by sidewall sections 62, 64, 66 and 68 provides room for the ratchet teeth of closure 14 to engage engagement surfaces 48 to provide for anti-rotation, as discussed above.

As shown in FIG. 3, the radii of the radially outermost surface of lugs 40, 42, 44 and 46 are greater than the radius of outer surface 26, and in particular are greater than the radius measured at sidewall sections 62, 64, 66 and 68. Further, the radially outermost surface of buttresses 50, 52, 54 and 56 are greater than the radius of outer surface 26, and in particular are greater than the radius measured at sidewall sections 62, 64, 66 and 68. Lastly, the outermost radii of buttresses 50, 52, 54 and 56 are less than or equal to the radii of the radially outermost surface of lugs 40, 42, 44 and 46. As noted above, in the embodiment shown each buttress 50, 52, 54 and 56 includes a continuous arc portion having a single radius forming a majority of the buttress. In the embodiment shown, the radius of the continuous arc portion is slightly less than the radii of the outermost surfaces of lugs 40, 42, 44 and 46. This configuration provides for the radial extension of both lugs 40, 42, 44 and 46 and buttresses 50, 52, 54 and 56 beyond outer surface 26 of neck finish 16.

Figure 4:
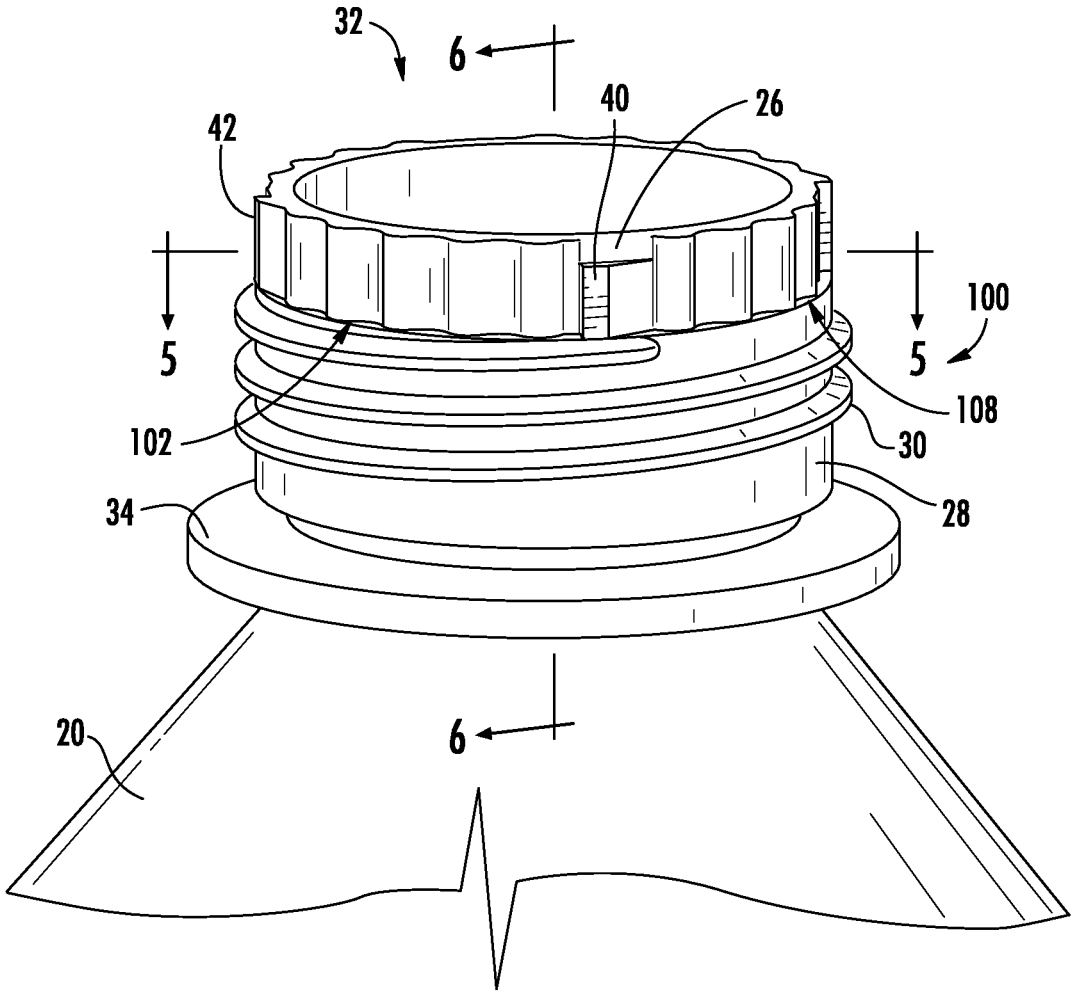
FIG. 4 is a detailed view of the neck finish of a container according to another exemplary embodiment.
Figure 5:
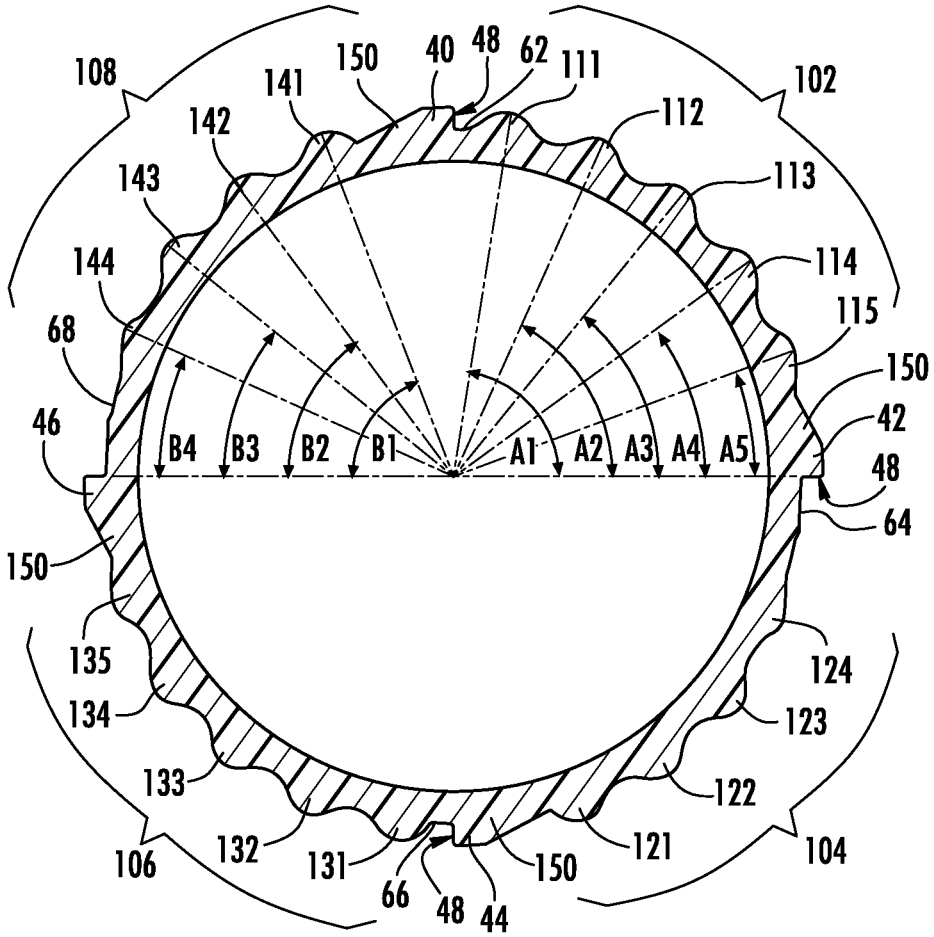
FIG. 5 is a top, cross-sectional view of the neck finish of FIG. 4 according to an exemplary embodiment.

Referring to FIG. 4 and FIG. 5, a bottle 10 including a neck finish 100 is shown including buttresses, shown as a first buttress 102, a second buttress 104, a third buttress 106 and a fourth buttress 108, according to another exemplary embodiment. Neck finish 100 is substantially the same as neck finish 16 except primarily for the structure of buttresses 102, 104, 106, 108 discussed below. Further, buttresses 102, 104, 106, and 108 are similar to buttresses 50, 52, 54 and 56, respectively, except for the plurality of recesses formed in the outer surface of buttresses 102, 104, 106 and 108 dividing each buttress 102, 104, 106 and 108 into a plurality of raised ribs or ridges.

Generally, buttresses 102 and 106 include an odd number of ribs, and buttresses 104 and 108 include an even number of ribs. Specifically, as shown best in FIG. 5, buttress 102 includes five ribs, shown as ribs 111-115, buttress 104 includes ribs, shown as ribs 121-124, buttress 106 includes five ribs, shown as ribs 131-135, and buttress 108 includes four ribs, shown as ribs 141-144. As can be seen in FIG. 5, the ribs of buttresses 102, 104, 106 and 108 extend radially outward from outer surface 26 of the upper portion 22 of neck finish 100. Further, as can be seen in FIG. 4, the ribs of buttresses 102, 104, 106 and 108 extend longitudinally along outer surface 26 of the upper portion 22 of neck finish 100 in a direction substantially parallel to the longitudinal axis of the container. In the embodiment shown, the ribs of buttresses 102, 104, 106 and 108 extend the entire length of upper section 22 from the upper edge that defines opening 32 to just above the start of threads 30.

Similar to neck finish 16, neck finish 100 includes four sidewall sections 62, 64, 66 and 68 located between each buttresses 102, 104, 106 and 108 and the clockwise facing engagement surfaces 48 of the lugs located immediately counterclockwise from each buttress. As shown in FIG. 5, each anti-rotation lug 40, 42, 44 and 46 includes a counterclockwise facing tapered section 150 that provides a tapered gradual transition extending radially inward toward the outer surface of the neck finish and toward the clockwise facing edge of the adjacent rib. Similar to tapered section 60 discussed above, tapered section 150 allows the ratchet teeth of the closure to cam over the anti-rotation lugs during threading of closure 14 onto the neck finish.

Referring to FIG. 5, four of the five ribs of buttress 102 (ribs 111-114) have outer radii that are substantially equal (i.e., within plus or minus 0.005 inches) to each other. The fifth rib 115 of buttress 102 has an outer radius that is less than the outer radii of ribs 111-114. Similar to buttress 102, four of the five ribs of buttress 106 (ribs 131-134) have outer radii that are substantially equal to each other. The fifth rib 135 of buttress 106 has an outer radius that is less than the outer radii of ribs 131-134. Three of the four ribs of buttress 104 (ribs 121-123) have outer radii that are substantially equal to each other. The fourth rib 124 of buttress 104 has an outer radius that is less than the outer radii of ribs 121-123. Similar to buttress 104, three of the four ribs of buttress 108 (ribs 141-143) have outer radii that are substantially equal to each other. The fourth rib 144 of buttress 108 has an outer radius that is less than the outer radii of ribs 141-143.

Short rib 115 of first buttress 102, and short rib 124 of second buttress 104 are adjacent to and located on opposite sides of second anti-rotation lug 42. Specifically, short rib 115 is adjacent to the counterclockwise facing tapered section 150 of lug 42, and short rib 124 is adjacent to the clockwise facing engagement surface 48 of lug 42. Short rib 135 of third buttress 106 and short rib 144 of fourth buttress 108 are adjacent to and located on opposite sides of fourth anti-rotation lug 46. Specifically, short rib 135 is adjacent to the counterclockwise facing tapered section 150 of lug 46, and short rib 144 is adjacent to the clockwise facing engagement surface 48 of lug 46. Further, as shown in FIG. 5, outer surface sections 64 and 68 have a greater circumferential length than outer surface sections 62 and 66.

In one embodiment as shown in FIG. 5, buttress 102 and buttress 106 are radially symmetric to each other, and buttress 104 and buttress 108 are radially symmetric to each other. Accordingly, the radii of ribs 111-114 and of ribs 131-134 are substantially equal to each other, and the radius of rib 115 is substantially equal to the radius of rib 135. Further, the radii of ribs 121-123 and of ribs 141-143 are substantially equal to each other, and the radius of rib 124 is substantially equal to the radius of rib 144. Further as shown in FIG. 5, each 90 degree quadrant of the neck finish may be radially symmetric with the opposing quadrant. Accordingly, in addition to the symmetry of the buttress as discussed above, the circumferential length of outer surface sections 64 and 68 are substantially equal and the circumferential length of outer surface sections 62 and 66 are substantially equal.

In various embodiments, the angular spacing between the ribs within each buttress are selected to provide sufficient neck reinforcement while providing a shaped that provides for unobstructed mold opening. Referring to FIG. 5, angles A1-A5 define the angle between the horizontal axis defined by engagement surface 48 of lug 42 and ribs 111-115, respectively. In various embodiments, angle A1 is between 80 and 81 degrees, and specifically is 81 degrees 30 minutes. Angle A2 is between 66 and 67 degrees, and specifically is 66 degrees and 22 minutes. Angle A3 is between 50 degrees and 51 degrees, and specifically is 51 degrees and 14 minutes. Angle A4 is between 36 and 37 degrees, and specifically is 36 degrees and 7 minutes. Angle A5 is between 20 degrees and 21 degrees, and specifically, is 20 degrees and 59 minutes. In other embodiments, angles A1-A5 may be any one of the above identified angles plus or minus 5 degrees, and in another embodiment, angles A1-A5 may be any one of the above identified angles plus or minus 2 degrees.

Referring to FIG. 5, angles B1-B4 define the angle between the horizontal axis defined by engagement surface 48 of lug 46 and ribs 141-141, respectively. In various embodiments, angle B1 is between 68 and 70 degrees, and specifically is 69 degrees. Angle B2 is between 53 and 55 degrees, and specifically is 54 degrees. Angle B3 is between 38 degrees and 40 degrees, and specifically is 39 degrees. Angle B4 is between 23 and 25 degrees, and specifically is 24 degrees. In other embodiments, angles B1-B4 may be any one of the above identified angles plus or minus 5 degrees, and in another embodiment, angles B1-B4 may be any one of the above identified angles plus or minus 2 degrees. It should be understood that because of the radially symmetry of the embodiment shown, the corresponding angles of buttress 106 are the same as the angles discussed above for buttress 102 and the corresponding angles of buttress 104 are the same as the angles discussed above for buttress 108.

Thus, as shown, the angular spacing between each adjacent ribs within each buttress 102, 104, 106 and 108 is between 14 and 16 degrees, and more specifically is between 14.5 degrees and 15.5 degrees. In another embodiment, the angular spacing between each adjacent ribs within each buttress 102, 104, 106 and 108 is 15 degrees plus or minus a half of a degree, and more specifically is 15 degrees plus or minus a quarter of a degree.

Referring to FIG. 5, the cross-sectional shape of each rib of buttresses 102, 104, 106 and 108 are shown taken in a plane perpendicular to the longitudinal axis of the container. As shown, the cross-sectional shape of each rib is different from the cross-sectional shapes of the other ribs of a particular buttress. Thus, each rib shape is unique relative to the other ribs of the same buttress. In other words, within a particular buttress no two ribs have the same cross-sectional shape in the plane perpendicular to the longitudinal axis of the container. This shaping may provide more robust reinforcement characteristics and easier disengagement from a mold buttress with repeating rib shapes.

As shown in FIG. 5, the outer surface of each rib of buttresses 102, 104, 106 and 108 is a rounded outer surface. The rounded outer surface may facilitate closure attachment by allowing the ratchet teeth of closure 14 to cam over the ribs during threading. In other embodiments, the ribs of buttresses 102, 104, 106 and 108 may be square, triangular, multi-facetted or other non-round shapes.

It should be noted that the clockwise and counterclockwise orientations of components discussed herein are selected based on the orientation of the threading to which the closure is connected. Specifically, the clockwise and counterclockwise orientations discussed herein are selected based on threading which requires clockwise rotation of a closure to engage the thread. It should be noted that the orientations of components discussed here may be reversed to accommodate a neck finish with threading which requires counterclockwise rotation of a closure to engage the thread, and any such orientation language should be interpreted as a relative orientation, for example relative to the orientation of threading on the neck finish.

Figure 6:
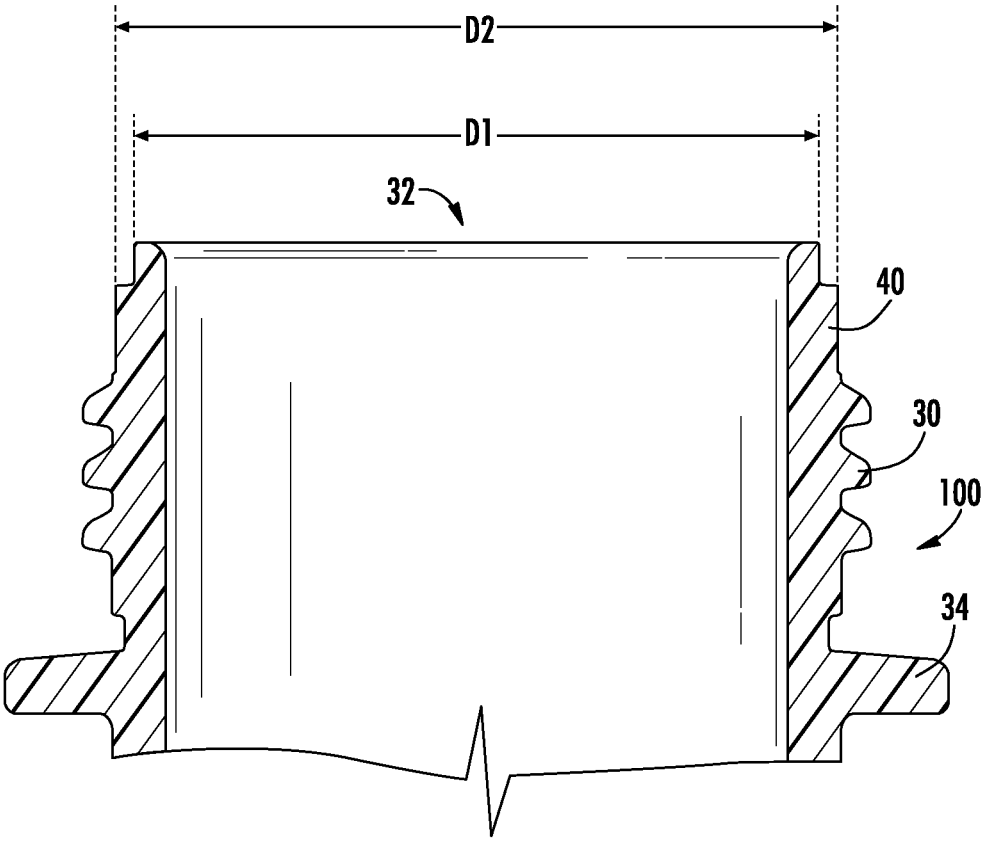
FIG. 6 is a side cross-sectional view of the neck finish of FIG. 4 according to an exemplary embodiment.

Referring to FIG. 6, a side cross-sectional view of neck finish 100 is shown according to an exemplary embodiment. In the embodiment shown, neck finish 100 is configured to be closed with a closure having an outer diameter of about 33 mm. As shown in FIG. 6, diameter D1 defines the diameter between opposing sections of outer surface 26 of neck finish 100, and diameter D2 defines the diameter between opposing outer most surfaces of lugs 40, 42, 44 and 46. In the embodiment shown, D2 also defines the diameter between opposing ribs 111-114 of buttresses 102 and ribs 131-134 of buttress 106, respectively. D2 also defines the diameter between ribs 121-123 of buttresses 104 and ribs 141-143 of buttress 108, respectively. In the embodiment shown, D1 is between 1.2 and 1.1 inches, specifically between 1.15 and 1.05 inches, and more specifically is about 1.09 inches. In the embodiment shown, D2 is between 1.3 and 1.0 inches, specifically between 1.1 and 1.2 inches, and more specifically is between about 1.15 and 1.17 inches. In one specific embodiment, D2 is about 1.16 inches, and more specifically is about 1.159 inches.

Figure 7:
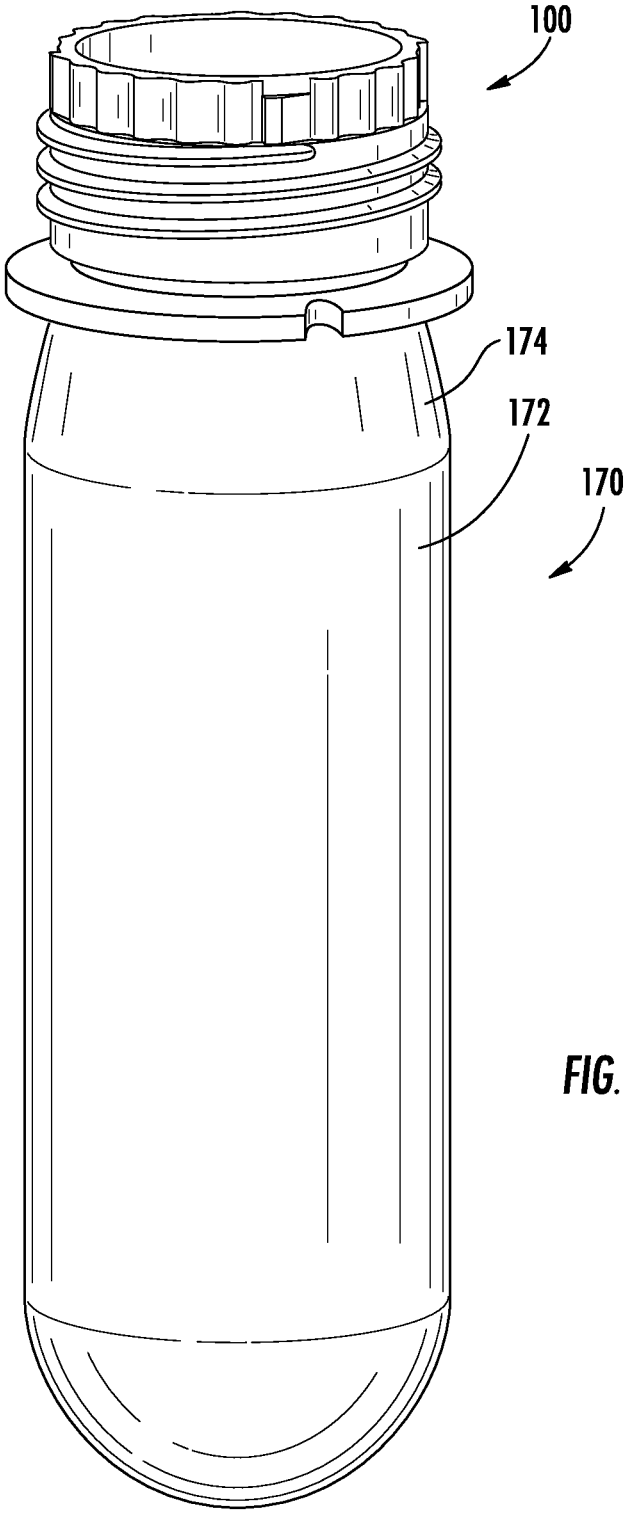
FIG. 7 is a perspective view of a preform according to an exemplary embodiment.

Referring to FIG. 7, a preform 170 is shown according to an exemplary embodiment. Perform 170 includes a preform body 172 and neck finish 100 extending from the upper end of preform body 172. Preform 170 includes a tapered section 174 joining the neck finish to the body. In another embodiment, preform 170 may include neck finish 16 instead of neck finish 100. In one embodiment, preform 170 is formed via an injection molding procedure. To produce bottle 10, preform 170 may be blow-molded such that preform body 172 expands to form container body 12. In such a blow molding process, neck finish 100 may be shielded or protected during blow molding to limit or prevent distortion of the neck finish during blow molding. In such an embodiment, neck finish 100 remains substantially the same before and after the blow molding process, while preform body 172 is expanded to create a bottle body, such as body 12 shown in FIG. 1.

Figure 8:
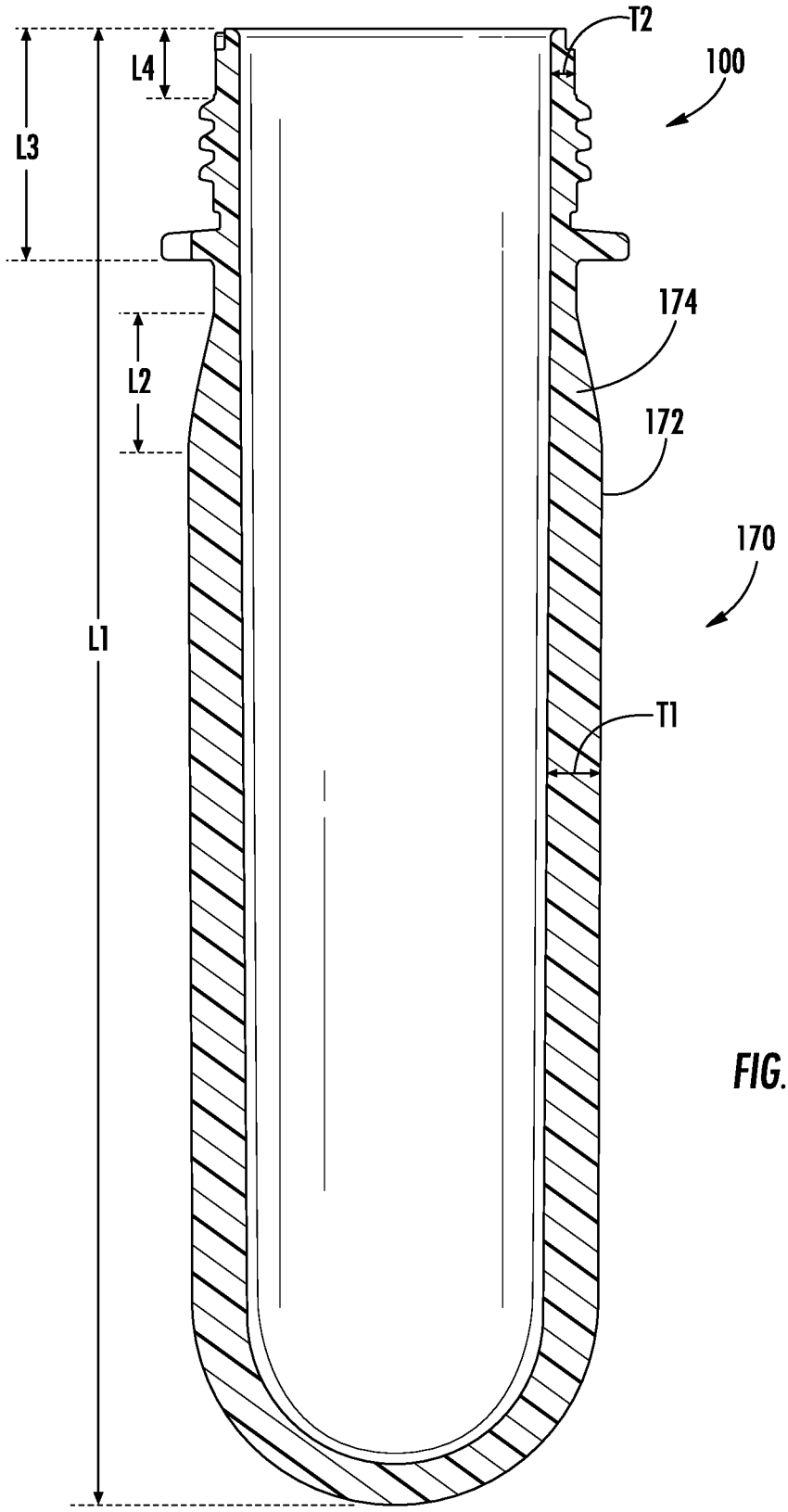
FIG. 8 is a cross-sectional view of the preform of FIG. 7 according to an exemplary embodiment.

Referring to FIG. 8, a cross-sectional view of preform 170 is shown according to an exemplary embodiment. Preform 170 is structured, sized and shaped to produce a bottle via a blow molding process. As shown in FIG. 8, the wall thickness of preform body 172, shown as T1, is greater than the wall thickness of neck finish 100, shown as T2. The thicknesses T1 and T2 are selected to produce a bottle upon blow molding. In one embodiment, T1 is greater than twice T2, specifically T1 is between 2 times and 2.5 times T2, and more specifically T1 is between 2 times and 2.1 times T2. In the specific embodiment shown, T1 is between 2.03 times and 2.04 times T2, and is about 2.0355 times T2. T2 remains substantially the same or unchanged after blow molding, and the thickness of the body wall in the completed bottle is less than T1.

As shown in FIG. 8, tapered section 174 joins neck finish 100 to preform body 172, and specifically tapered section 174 is shaped to provide a transition from the thinner sidewall of neck 100 to the thicker sidewall of body 172. In the embodiment shown, the outer surface of tapered section 174 is angled relative to the longitudinal axis of preform 170 such that the outer surface of tapered section 174 extends both downward from neck 100 and radially outward to join to the outer surface of body 172. Tapered section 174 is sized to produce to the desired angle and length of upper body portion 20 in the blow molded bottle, for example as shown in FIG. 1. As shown in FIG. 8, preform 170 has a longitudinal length L1 and tapered section 174 has a longitudinal length L2. In one embodiment, L1 is greater than 10 times L2, specifically L1 is between 10 times and 15 times greater than L2, and more specifically is between 11 times and 14 times L2. In the specific embodiment shown, L1 is between 12 times and 13 times L2, specifically L1 is between 12.25 times and 12.75 times L2, and more specifically L1 is between 12.50 times and 12.75 times L2. In one embodiment, L1 is about 12.67 times L2. As noted above, various relative size and shapes of the portions of preform 170 allow for the production of a blow molded bottle having the reinforced neck finish features discussed herein.

As shown in FIG. 8, L3 is the longitudinal length of neck finish 100 measured between the upper most edge of preform 170 and the lower most surface of collar 34, and L4 is the longitudinal length of the ribs of buttresses 102, 104, 106, and 108. In the embodiment shown, the ribs of buttresses 102, 104, 106, and 108 extend the entire longitudinal distance along upper section 26 between the upper edge of the neck finish and the upper edge of the threads, and, as such, in this embodiment, L4 is also the longitudinal length of upper section 26. The lengths of ribs of buttresses 102, 104, 106, and 108 are sized to reinforce neck finish 100 and in particular reinforce the upper portion of neck 100 against cracking during impact. In the embodiment shown, L4 is less half of L3, and more specifically L4 is less than one third of L3. In other embodiments, L4 is between ½ and 1/10 of L3, specifically is between 0.4 times and 0.2 times L3, and more specifically is between 0.35 and 0.25 times L3. In the specific embodiment shown, L3 is 0.3 times L4. Further in the embodiment shown, the L3 is less than the longitudinal length of the threads.

The figures illustrate the exemplary embodiments in detail, it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. Other substitutions, modifications, changes and omissions may also be made in the design, operating conditions and arrangement of the various exemplary embodiments without departing from the scope of the present invention.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description. In particular, various dimensions, angles, relative dimensions, relative angles, ratios of various dimensions and ratios of various angles, etc. are shown (or determinable via measurement) in the drawings of the attached appendix, and any such dimensions, angles, relative dimensions, relative angles, ratios of various dimensions and ratios of various angles, may be claimed in this or future applications.

The containers discussed herein may be formed from any material, including metals, plastics, ceramics and glasses. In one embodiment, the container discussed herein is made from PVC. In another embodiment, the container discussed herein is made from PETE. In other embodiments, other polymer materials may be used (e.g., polypropylene, polyethylene, etc.). Further, containers discussed herein may be a multilayer container including one or more barrier layer to limit oxygen or contaminant migration through the container. In such embodiments the barrier material may be located anywhere within the wall structure of the container such that the barrier is between the container contents and exterior of the container. In some embodiments, the barrier layer forms the inner surface of the container, the outer surface of the container and internal layer of the wall of the container, or any combination of one or more of these barrier locations. Suitable barrier materials include EVOH and fluorinated polyethylene.

Containers discussed herein may include containers of any style, shape, size, etc. For example, the containers discussed herein may be shaped such that cross-sections taken perpendicular to the longitudinal axis of the container are generally circular. However, in other embodiments the sidewall of the containers discussed herein may be shaped in a variety of ways (e.g., having other non-polygonal cross-sections, as a rectangular prism, a polygonal prism, any number of irregular shapes, etc.) as may be desirable for different applications or aesthetic reasons. Container 10 may be of various sizes (e.g., 3 oz., 8 oz., 12 oz., 15 oz., 28 oz, etc.) as desired for a particular application.

What is claimed is:

1. A plastic container comprising:

a body;

a neck portion extending from the body, the neck portion comprising an upper section having an outer surface and a lower section having an outer surface, the lower section positioned between the body and the upper section;

threads extending radially outward from the outer surface of the lower section of the neck portion, the threads configured to engage a closure;

a first anti-rotation lug extending radially outward from the outer surface of the upper section of the neck portion, the first anti-rotation lug having a clockwise facing engagement surface;

a second anti-rotation lug extending radially outward from the outer surface of the upper section of the neck portion and spaced apart from the first anti-rotation lug, the second anti-rotation lug having a clockwise facing engagement surface; and a first buttress having an outermost surface, the first buttress extending radially outward from the outer surface of the upper section of the neck portion and positioned between the first and second anti-rotation lugs, the first buttress reinforcing the neck portion between the first and second anti-rotation lugs;

wherein the outermost surface of the first buttress is a continuous arc having a constant radius over at least a portion of the length of the first buttress, the first buttress extending between a clockwise end contiguous with the first anti-rotation lug and a counter-clockwise facing tapered end.

2. The plastic container of claim 1 further comprising;

a third anti-rotation lug extending radially outward from the outer surface of the upper section of the neck portion, the third anti-rotation lug having a clockwise facing engagement surface;

a fourth anti-rotation lug extending radially outward from the outer surface of the upper section of the neck portion, the fourth anti-rotation lug having a clockwise facing engagement surface;

a second buttress extending radially outward from the outer surface of the upper section of the neck portion and positioned between the second and third anti-rotation lugs, the second buttress reinforcing the neck portion between the second and third anti-rotation lugs;

a third buttress extending radially outward from the outer surface of the upper section of the neck portion and positioned between the third and fourth anti-rotation lugs, the third buttress reinforcing the neck portion between the third and fourth anti-rotation lugs; and a fourth buttress extending radially outward from the outer surface of the upper section of the neck portion and positioned between the fourth and first anti-rotation lugs, the fourth buttress reinforcing the neck portion between the fourth and first anti-rotation lugs;

the second buttress extending between a clockwise end contiguous with the second anti-rotation lug and a counter-clockwise facing tapered end;

the third buttress extending between a clockwise end contiguous with the third anti-rotation lug and a counter-clockwise facing tapered end;

the fourth buttress extending between a clockwise end contiguous with the fourth anti-rotation lug and a counter-clockwise facing tapered end;

the second, third and fourth buttresses each having an outermost surface, wherein the outermost surface of each of the second, third and fourth buttresses is a continuous arc having a constant radius over at least a portion of the length of the buttress;

wherein the constant radius portion of the continuous arc of each of the first, second, third, and fourth buttresses extends along at least more than half the length of each buttress.

3. The plastic container of claim 2 wherein each of the first, second, third and fourth buttresses extends more than 30 percent of the circumferential distance between adjacent anti-rotation lugs.

4. The plastic container of claim 3, wherein the engagement surfaces of adjacent anti-rotation lugs are spaced from each other by between 89 and 90 degrees.

5. A container comprising:

a body;

an opening;

a neck portion extending from the body to the opening, the neck portion comprising an upper section having an outer surface and a lower section having an outer surface, the lower section positioned between the body and the upper section;

threads extending radially outward from the outer surface of the lower section of the neck portion, the threads configured to engage a closure;

a first anti-rotation lug extending radially outward from the outer surface of the upper section of the neck portion, the first anti-rotation lug having a clockwise facing engagement surface;

a second anti-rotation lug extending radially outward from the outer surface of the upper section of the neck portion, the second anti-rotation lug having a clockwise facing engagement surface;

a third anti-rotation lug extending radially outward from the outer surface of the upper section of the neck portion, the third anti-rotation lug having a clockwise facing engagement surface;

a fourth anti-rotation lug extending radially outward from the outer surface of the upper section of the neck portion, the fourth anti-rotation lug having a clockwise facing engagement surface;

a first buttress extending radially outward from the outer surface of the upper section of the neck portion and positioned between the first and second anti-rotation lugs, the first buttress reinforcing the neck portion between the first and second anti-rotation lugs;

a second buttress extending radially outward from the outer surface of the upper section of the neck portion and positioned between the second and third anti-rotation lugs, the second buttress reinforcing the neck portion between the second and third anti-rotation lugs;

a third buttress extending radially outward from the outer surface of the upper section of the neck portion and positioned between the third and fourth anti-rotation lugs, the third buttress reinforcing the neck portion between the third and fourth anti-rotation lugs; and a fourth buttress extending radially outward from the outer surface of the upper section of the neck portion and positioned between the fourth and first anti-rotation lugs, the fourth buttress reinforcing the neck portion between the fourth and first anti-rotation lugs;

a first section of the outer surface of the neck portion located between the first anti-rotation lug and the first buttress;

a second section of the outer surface of the neck portion located between the second anti-rotation lug and the second buttress;

a third section of the outer surface of the neck portion located between the third anti-rotation lug and the third buttress; and a fourth section of the outer surface of the neck portion located between the fourth anti-rotation lug and the fourth buttress;

wherein outermost radii of the first, second, third and fourth sections of the outer surface of the neck portion are less than the outermost radii of the first, second, third and fourth buttresses; and wherein outermost radii of the first, second, third and fourth sections of the outer surface of the neck portion are less than the outermost radii of the first, second, third and fourth anti-rotation lugs.

6. The container of claim 5, wherein the outermost radii of the first, second, third and fourth buttresses are less than or equal to the outermost radii of the first, second, third and fourth anti-rotation lugs.

7. The container of claim 6, wherein:

the first section of the outer surface of the neck portion is located immediately adjacent to the engagement surface of the first anti-rotation lug;

the second section of the outer surface of the neck portion is located immediately adjacent to the engagement surface of the second anti-rotation lug;

the third section of the outer surface of the neck portion is located immediately adjacent to the engagement surface of the third anti-rotation lug; and the fourth section of the outer surface of the neck portion is located immediately adjacent to the engagement surface of the fourth anti-rotation lug.

8. The container of claim 7, wherein:

the first buttress is contiguous with the second anti-rotation lug and extends at least half of the circumferential distance between the first and second anti-rotation lugs;

the second buttress is contiguous with the third anti-rotation lug and extends at least half of the circumferential distance between the second and third anti-rotation lugs;

the third buttress is contiguous with the fourth anti-rotation lug and extends at least half of the circumferential distance between the third and fourth anti-rotation lugs; and the fourth buttress is contiguous with the first anti-rotation lug and extends at least half of the circumferential distance between the fourth and first anti-rotation lugs.

9. The container of claim 8, wherein the outermost surfaces of the first, second, third and fourth buttresses are substantially continuous arcs each having radii substantially the same as the outermost radii of the first, second, third and fourth anti-rotation lugs.

10. The container of claim 5, wherein:

the first buttress is an odd number of raised ribs;

the second buttress is an even number of raised ribs;

the third buttress is an odd number of raised ribs;

the fourth buttress is an even number of raised ribs; and the raised ribs of the first, second, third and fourth buttresses extend radially outward from the outer surface of the upper section of the neck portion and extend longitudinally downward along the outer surface of the upper section of the neck portion in a direction substantially parallel to a longitudinal axis of the container.

11. The container of claim 10, wherein the cross-sectional shape of each rib of each buttress is different from the cross-sectional shape of each other rib of the same buttress, the cross-section taken in a plane perpendicular to the longitudinal axis of the container, wherein the angular spacing between each rib of each buttress is 15 degrees plus or minus a half of a degree.

12. The container of claim of claim 10, wherein the longitudinal lengths of the raised ribs of the buttresses are less than a third of the length of the neck portion.

13. The container of claim of claim 10, wherein the longitudinal lengths of the raised ribs of the buttresses are less than half of the length of the neck portion.

14. The container of claim 10, wherein the cross-sectional shape of each rib of each buttress is different from the cross-sectional shape of each other rib of the same buttress, the cross-section taken in a plane perpendicular to the longitudinal axis of the container.

15. The container of claim of claim 14, wherein the engagement surfaces of the first, second, third and fourth anti-rotational lugs are substantially perpendicular to the outer surface of the upper section of the neck finish.

16. The container of claim 10, wherein:

the first buttress is five raised ribs;

the second buttress is four raised ribs;

the third buttress is five raised ribs; and the fourth buttress is four raised ribs.

17. The container of claim 16, wherein the angular spacing between each rib of each buttress is 15 degrees plus or minus a half of a degree, and further wherein the angular spacing between engagement surfaces of adjacent anti-rotation lugs is 90 degrees plus or minus 1 degree.

18. The container of claim 16, wherein the angular spacing between each rib of each buttress is between 14 and 16 degrees, and further wherein the angular spacing between engagement surfaces of adjacent anti-rotation lugs is between 89 and 90 degrees.

19. The container of claim 16, wherein:

the outer radii of four of the five ribs of the first buttress are substantially equal to each other and the outer radius of the fifth rib of the first buttress is less than the radii of the other four ribs of the first buttress;

the outer radii of three of the four ribs of the second buttress are substantially equal to each other and the outer radius of the fourth rib of the second buttress is less than the radii of the other three ribs of the second buttress;

the outer radii of four of the five ribs of the third buttress are substantially equal to each other and the outer radius of the fifth rib of the third buttress is less than the radii of the other four ribs of the third buttress; and the outer radii of three of the four ribs of the fourth buttress are substantially equal to each other and the outer radius of the fourth rib of the fourth buttress is less than the radii of the other three ribs of the fourth buttress.

20. The container of claim 19, wherein:

the fifth rib of the first buttress and the fourth rib of the second buttress are adjacent to and on opposite sides of the second anti-rotation lug;

the fifth rib of the third buttress and the fourth rib of the fourth buttress are adjacent to and on opposite sides of the fourth anti-rotation lug;

the first, second, third and fourth anti-rotation lugs are spaced at 90 degree intervals from each other around the circumference of the neck portion.

* * * * *